US005331319A

United States Patent [19]

Ebersohl

[11] Patent Number: 5,331,319

[45] Date of Patent: Jul. 19, 1994

[54] DEVICE FOR SIGNALLING THE POSITION OF A MOBILE MEMBER

[75] Inventor: Gérard Ebersohl, La Mulatiere, France

[73] Assignee: Gec Alsthom SA, Paris, France

[21] Appl. No.: 868,952

[22] Filed: Apr. 16, 1992

[30] Foreign Application Priority Data

Apr. 16, 1991 [FR] France ..... 91 04631

[51] Int. Cl.[5] ..... G08C 19/16

[52] U.S. Cl. ..... 340/870.28; 340/870.29; 340/870.31; 340/555; 340/557; 359/151; 250/227.14

[58] Field of Search ..... 340/870.28, 870.29, 340/870.31, 555, 556, 557; 359/109-111, 151, 143; 250/227.14

[56] References Cited

U.S. PATENT DOCUMENTS 3,984,824 10/1976 Blackburn ..... 340/870.29
4,490,606 12/1984 Lockett et al. ..... 340/870.29
4,626,621 12/1986 Hiyama et al. ..... 178/18
5,229,876 7/1993 Fatehi et al. ..... 340/870.28

FOREIGN PATENT DOCUMENTS 027275 6/1988 European Pat. Off. .
3219877 12/1983 Fed. Rep. of Germany .
3506602 8/1986 Fed. Rep. of Germany .
2485774 12/1981 France .
2165712 4/1986 United Kingdom .

*Primary Examiner*—Donnie L. Crosland
*Attorney, Agent, or Firm*—Sughrue, Mion, Zinn, Macpeak & Seas

[57] ABSTRACT

A device for signalling remotely the state of a device able to assume a plurality of discrete states comprises a circuit for producing inside a screened enclosure a direct current voltage free of interference. The screened enclosure contains a first circuit for producing from the direct current voltage electrical pulses whose duration is proportional to the value of an inductance which can assume distinct values according to the various states of the device. A second circuit converts the electrical pulses into optical pulses and an optical fiber transmits the pulses out of the enclosure to a processor.

8 Claims, 6 Drawing Sheets

DEVICE FOR SIGNALLING THE POSITION OF A MOBILE MEMBER

BACKGROUND OF THE INVENTION

1. Field of the Invention

The present invention concerns a device for signalling the position of a mobile member.

The invention finds an application in electrical engineering and this specification uses an illustrative example which is not of a limiting nature, of course.

The example concerns the signalling of the position of the contacts of an electrical switch such as a circuit-breaker. It is essential for the operator of an electrical plant incorporating devices such as circuit-breakers to be certain of the open or closed condition of the contacts of each circuit-breaker; this information, usually available at each circuit-breaker, is centralized at a control and monitoring station; it is essential that any failure of the signalling link connecting each of the devices to said station be reported immediately, failing which the signal received at the station may give reason to believe that a device is in a given state whereas it is in fact in the opposite state: any such error can have unfortunate consequences for the operating authority.

For the same reasons it is essential that the device which performs the signalling should, as far as possible, indicate that it is faulty itself or that its power supply has failed. This self-monitoring makes it possible to increase significantly the availability of the self-monitored part of the device.

Of course, the problem is not limited to sensing the position of circuit-breaker contacts; in electrical plant the state of pressure-switches, the oil pressure in hydraulic control circuits, oil levels, etc may all need to be signalled by means of a signalling contact.

Approximately 30% of serious failures of electrical plants are due to a bad signal contact; this indicates the magnitude of the problem.

An object of the invention is therefore to provide a device for signalling the state of a device by sensing this state and transmitting corresponding information, which guarantees error-free operation in respect of the sensed state, and which signals immediately its own failure and failure of the signalling link.

Another object of the invention is to provide a device which is insensitive to external influences such as electrical or magnetic fields and common mode interference when links without galvanic isolation are employed.

It is well known that the use of opto-electronic devices, fiber optics and screening provide a solution to the last-mentioned requirement. The next problem is that of the consumption of the device; another object of the invention is therefore to provide a device requiring for its operation no more energy than that which is available from a photovoltaic cell.

2. Description of the Prior Art

The U.S. Pat. No. 4,626,621 describes a circuit for determining the position of an object comprising two LR circuits driven by a squarewave signal from a pulse generator. One of the LR circuits includes a fixed inductor. The other includes an inductor whose value varies with the position of the object. Voltages are established in the circuits from a time t1 according to different exponential laws in the two circuits and the respective times t2 and t3 to establish a voltage of given value Vo in each of the two circuits is measured. The ratio $(t3-t1)/(t2-t1)$ provides a value representing the position concerned.

A circuit of this kind is complex because it comprises two LR circuits, two operational amplifiers, two counters, etc and it is unable to detect its own failure.

One object of the invention is to provide a circuit comprising the minimum of components and, as already mentioned, capable of signalling its own failure.

SUMMARY OF THE INVENTION

The invention consists in a device for signalling remotely the state of a device able to assume a plurality of discrete states, comprising:

- means for producing inside a screened enclosure a direct current voltage free of interference, said screened enclosure containing:
- first means for producing from said direct current voltage electrical pulses whose duration is proportional to the value of an inductance which can assume distinct values according to the various states of the device,
- second means for converting said electrical pulses into optical pulses and an optical fiber for transmitting said pulses out of said enclosure to a processor.

In one embodiment, said means for producing a direct current voltage comprise a photovoltaic cell inside said screened enclosure and adapted to be illuminated through a window in the latter by a light source. Alternatively said means for producing a direct current voltage comprise an integrated photovoltaic cell inside said screened enclosure and associated with an optical fiber fed with light by a laser diode.

In one particular embodiment, said first means comprises a circuit for producing rectangular pulses of constant duration separated by equal time intervals, an integrator receiving said pulses, a first inverter receiving the output signals of said integrator and supplying calibrated pulses at its output, a time constant circuit comprising a resistor and said inductor, the output signal of said first inverter being applied to the input of said time constant circuit and to a second inverter, the output signals of said time constant circuit and said second inverter being fed to the input of a third inverter whose output is connected to an amplifier driving said second means.

The second means is advantageously a photodiode.

The processing center advantageously comprises a demodulator circuit and a self-monitor circuit.

In one particular embodiment, said demodulator comprises a photovoltaic converter receiving the signal from said optical fiber, the Schmitt trigger and a D-type flip-flop.

The self-monitor circuit comprises advantageously a diode pump circuit driving an output transistor.

In another embodiment, said self-monitor circuit comprises an exclusive-OR gate connected by a first input on the input side of said D-type flip-flop and having a second input connected to a microcontroller adapted to apply to said second input a test pulse of duration exceeding the duration of said rectangular pulses, said microcontroller being connected to said D-type flip-flop and being programmed to observe a change of the position information during a monitoring period if the system is idle.

The invention will be better understood from the following description of one embodiment by way of non-limiting illustrative example only with reference to the appended drawings.

DETAILED DESCRIPTION OF THE INVENTION

Figures 1, 1A:
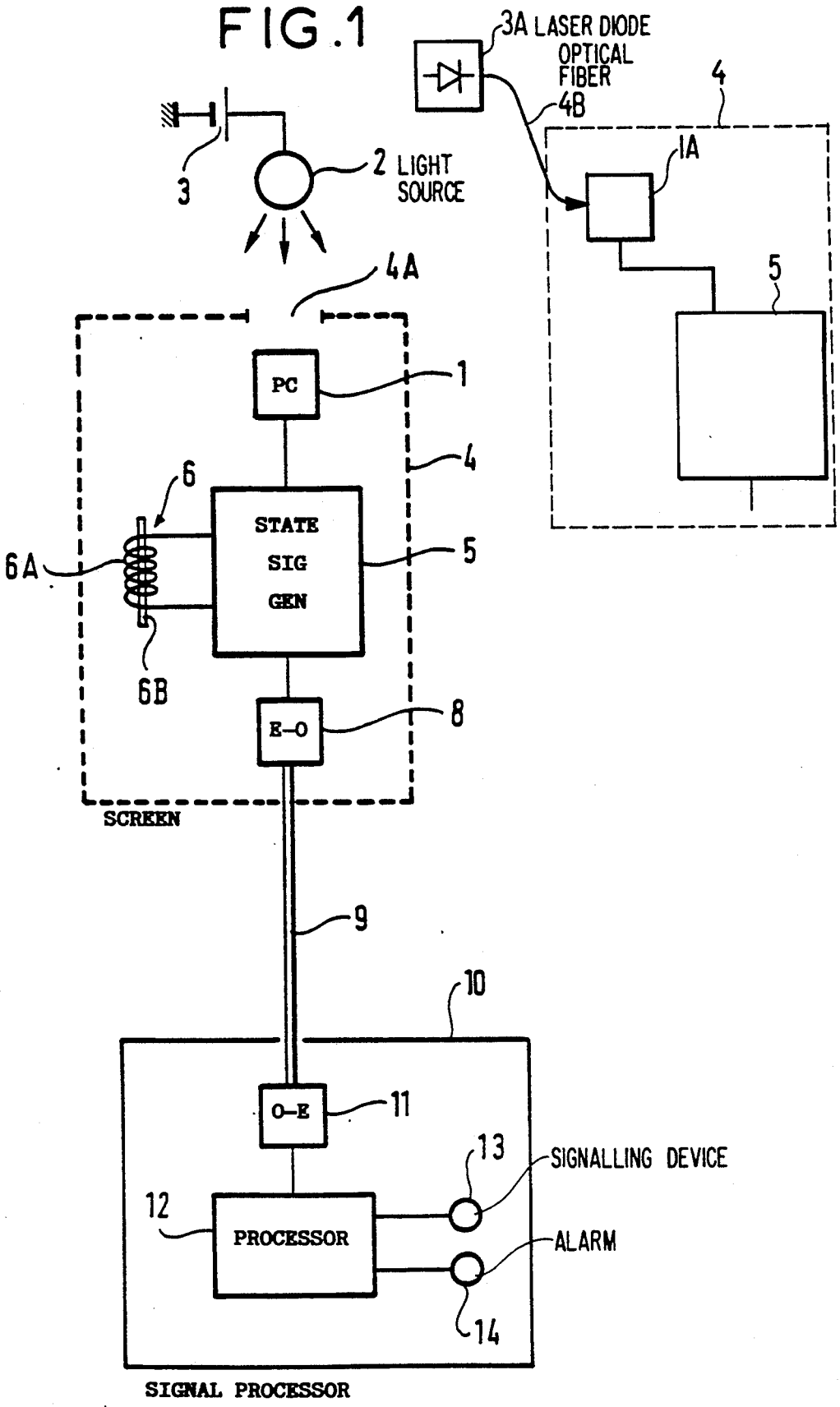
FIG. 1 is a block diagram of a device in accordance with the invention.
FIG. 1A is a partial diagram of a variation of the device illustrates in FIG. 1.

Referring to FIG. 1, a photovoltaic cell 1 is illuminated by a light source 2 in the form of an electric lamp connected to a battery 3. The photovoltaic cell is in a screened enclosure 4 which the light enters through a window 4A; the photovoltaic cell supplies a voltage Vcc of 5 V, for example, and can deliver a peak current of 20 mA; an electronic circuit 5 inside the screened enclosure and supplied with power by the cell 1 produces signals representing the state of the device; to this end the circuit comprises an inductor 6 having a coil 6A and a mobile core 6B linked to the mobile member of the device whose position is required to be known; the inductor 6 takes two different values depending on whether the core 6B is inside or outside the coil 6A and values which vary in proportion to the degree to which the core is inserted between the aforementioned two values. The electrical output signal of the circuit 5 is converted into a light signal by an optoelectronic device 8 and conveyed by an optical fiber 9 to the signal processor 10. Here an optoelectronic device 11 converts the light signal into an electrical signal which is received by a processor 12 feeding a signalling device 13 and an alarm 14, for example.

Because of the screening, the use of a photovoltaic cell to supply power and the transmission by optical fiber the measurements are protected from any possible interference (in particular, the absence of any direct connection without galvanic isolation avoids any common mode voltage at the position transducer).

As an alternative to this, and as shown in dashed FIG. 1A, the DC voltage is produced by an integrated photovoltaic cell 1A inside the screened enclosure (a SPECTEC ASGA cell, for example) connected by an optical fiber 4B passing through the wall of the screened enclosure and fed with light by a laser diode 3A.

Figure 2:
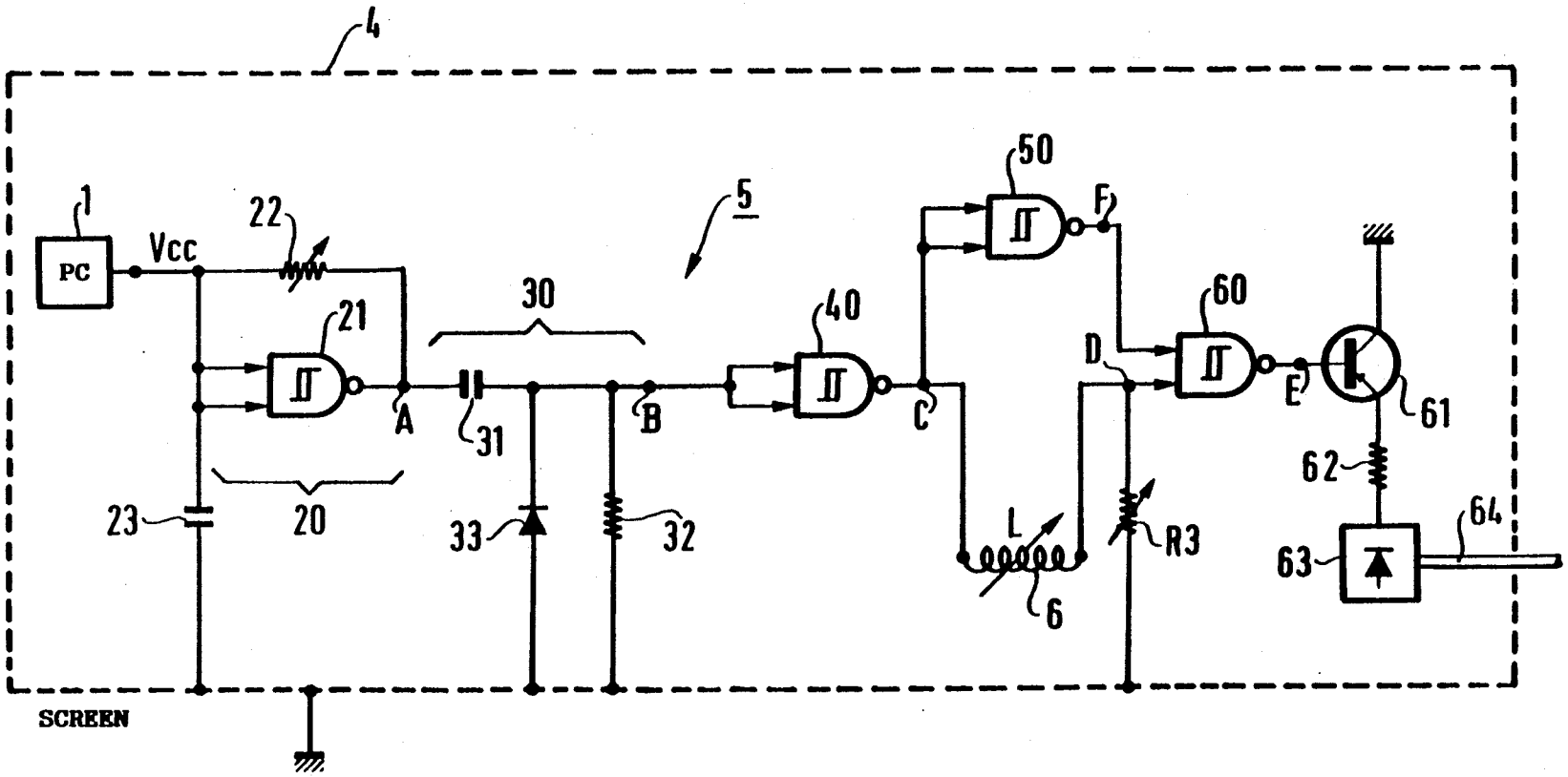
FIG. 2 is a circuit diagram of one embodiment of a circuit for producing pulses with a duration proportional to the value of an inductor.

Referring to FIG. 2, the circuit 5 comprises a Schmitt trigger 20 receiving the voltage Vcc and comprising an inverter 21, a variable resistor 22 and a capacitor 23; the Schmitt trigger delivers at an output A rectangular pulses whose rising edges are 100 microseconds apart, for example, and whose duration is 40 microseconds, for example (see diagram 3A).

At the output of the Schmitt trigger is an integrator 30 which comprises a capacitor 1, a resistor 32 and a diode 33 which strongly attenuates peaks due to the trailing edges of the pulses (diagram 3B).

The integrator is followed by an inverter 40 which has a threshold s1 and which supplies at an output C pulses with a calibrated length of 10 microseconds, for example (diagram 3C).

At C the signal is fed to a time constant circuit comprising the variable inductor 6 whose value is L and a variable resistor whose value is R3. The lefthand part of curve 3D shows the signal at the output D of the circuit LR3 when the inductor has a high value (core 6B inside coil 6A); the righthand part of curve 3D shows the signal at D when the inductor has a low value (core outside the coil). The difference between the curves is explained by the law governing the rise of a current i in a time constant circuit LR which is:

$$i = Imax(1 - \exp - t/t^*) \quad \text{(a)}$$

where t* is similar to L/R3 and Imax is near Vcc/R3, the coil resistance being negligible.

The output signal of the inverter 40 is inverted by an inverter 50 and the signal at the output F of the inverter 50 (diagram 3F) is sent at the same time as the signal at D to an inverter 60 which has a threshold s2 shown in diagram 3D.

Pulses of short duration (3 microseconds, for example) are obtained at the output of the inverter 60 when the value L of the inductor is low (core out) and longer duration (greater than 5 and less than 10 microseconds, for example) when the value L is high (core in); these pulses are respectively shown in the lefthand part and the righthand part of diagram 3G. Equation A shows that if the trigger threshold is constant the pulse width is directly proportional to L/R3 and therefore to L since R3 is substantially constant.

The output pulses from the inverter 60 are fed to a transistor 61 driving a light-emitting diode 63 (a Hewlett Packard TI510, for example) via a resistor 62. The LED 63 is connected to an optical fiber 64 which passes through the screen 4 and conveys information in the form of light pulses to a processor.

The capacitor Cc in parallel with the resistor R3 compensates for the internal capacitance of the coil.

In most applications the device in accordance with the invention is used to provide "signalling" contacts so that only two inductor values are required to determine two pulse widths. A coil with a ferromagnetic core (of mumetal, for example) in the form of a tongue is then used for the inductor; the two inductance values are determined by the ferromagnetic core being inside or completely outside the coil. This application is not limiting, of course, and consideration could be given to using more than two inductance values, with intermediate positions of the ferromagnetic core determining more than two pulse durations.

Figure 4:
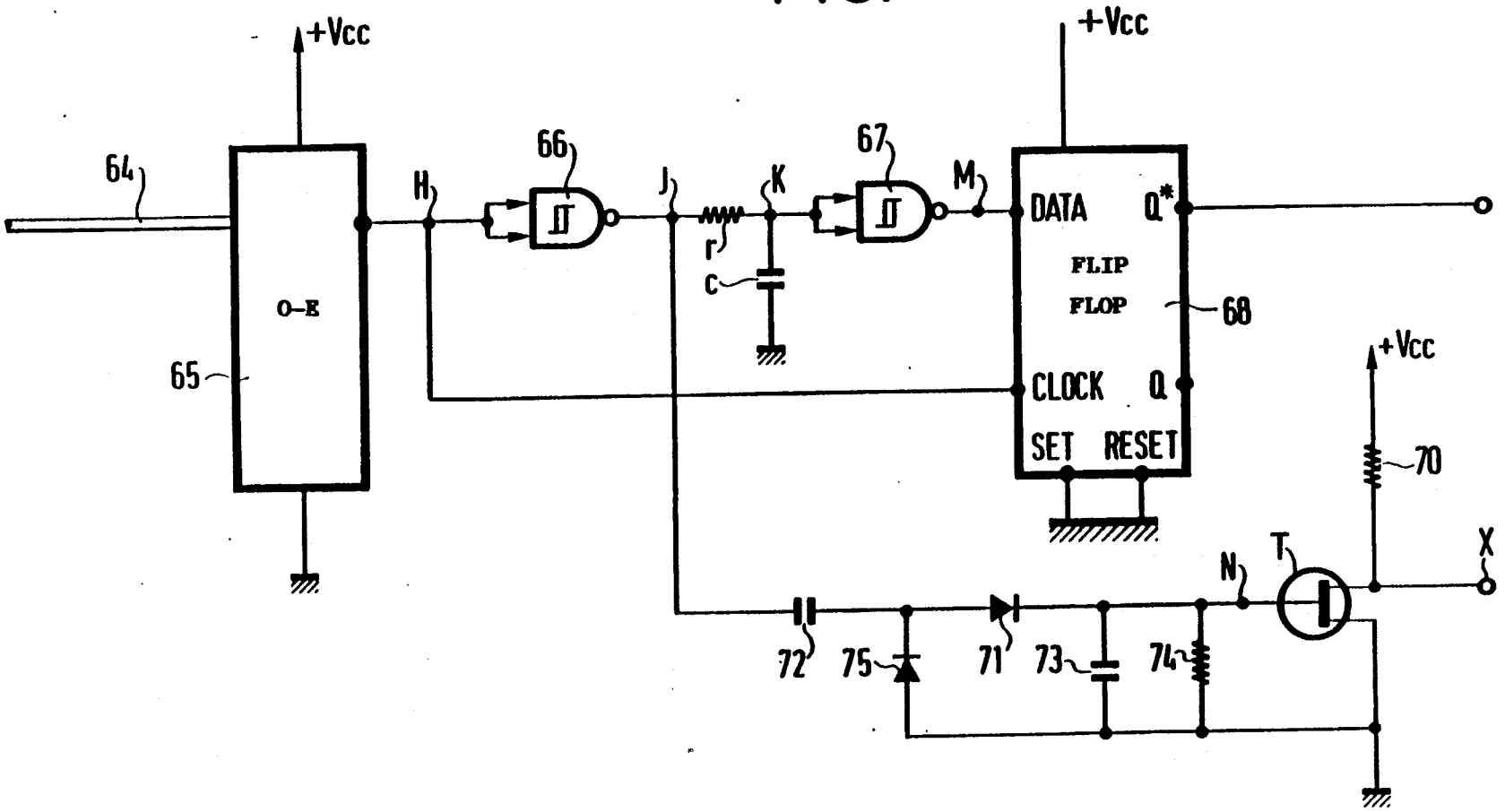
FIG. 4 is a block diagram of a monitor and self-monitor circuit.

FIG. 4 is a block diagram of the circuit monitoring the position of the signal contact and the self-monitor circuit.

Figure 3:
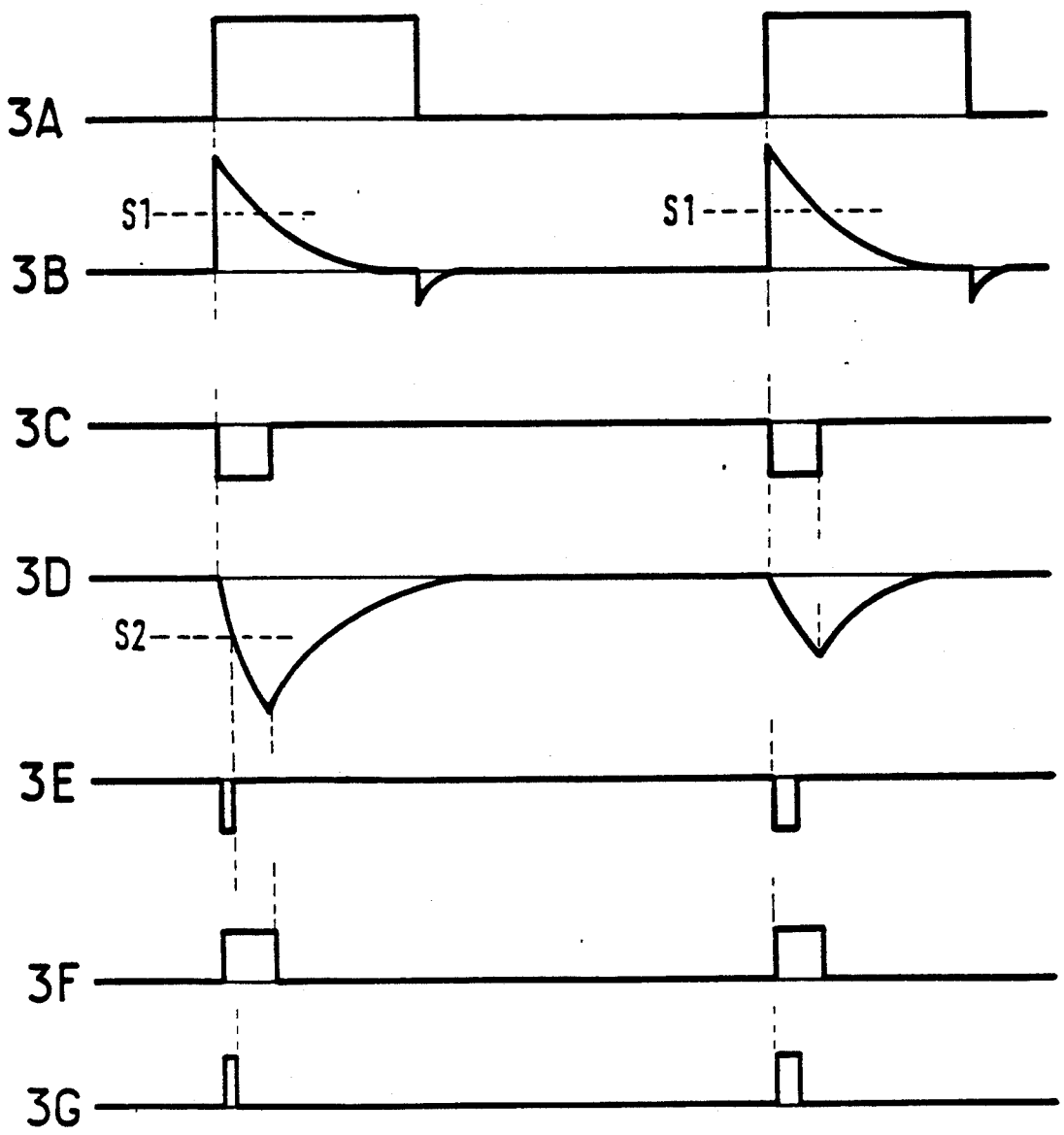
FIG. 3 comprises various diagrams explaining the operation of the FIG. 2 circuit.

The optical signals emitted by the inverter 63 from FIG. 3 are conveyed by an optical fiber 64 and converted into electrical signals by an opto-electronic converter 65, for example a Hewlett Packard 2501 circuit.

Figure 5:
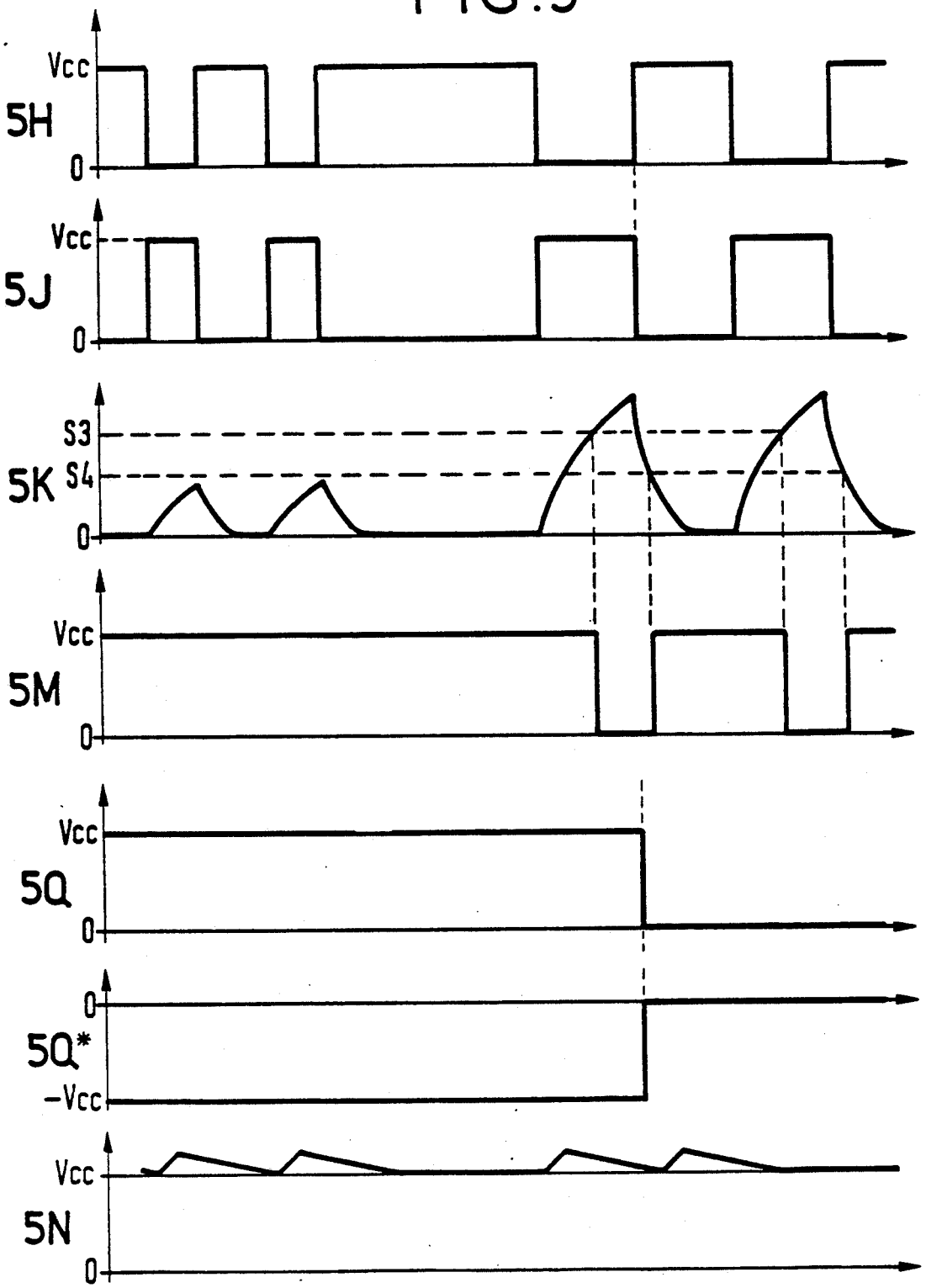
FIG. 5 comprises various diagrams explaining the operation of the FIG. 4 circuit.

The signals at the output H of the inverter (FIG. 4) are shown in diagram 5H in FIG. 5 showing two narrow pulses in the lefthand part of the diagram and two wide pulses in the righthand part of the diagram.

The pulses are inverted by an inverter 66; the signal at the output J of the inverter 66 (FIG. 4) is shown in diagram 5J in FIG. 5.

The signal at J is fed to a Schmitt trigger (an RCA 4093 device, for example) symbolically represented in FIG. 4 by a resistor r and a capacitor c; the signal at the output K of the Schmitt trigger (FIG. 4) is shown in diagram 5K in FIG. 5.

The signal at K is fed to an inverter 67 which has two thresholds s3 and s4 and whose output takes the value Vcc or the value 0; the signal state switches from Vcc to 0 when the input signal crosses the first threshold s3 and switches from 0 to Vcc when the signal crosses the second threshold s4 (s3>s4). The signal at the output M of the inverter 67 is shown in diagram 5M in FIG. 5.

The signal at M is fed to the "DATA" input of a D-type flip-flop 68 (for example a Control Data 4013 device) whose "CLOCK" input is connected to the point M. On each 0-1 transition of the signal at M the flip-flop provides at its output Q a signal reflecting the state of the "DATA" input. This signal is shown in diagram 5Q in FIG. 5. The contact "POSITION" indication is preferably provided by the complemented signal $\overline{Q^*}$ shown in diagram 5Q* in FIG. 5.

The demodulator circuit just described is associated with a self-monitor circuit of the signalling device in accordance with the invention. This self-monitor circuit comprises a "diode pump" conventionally comprising:

- a field-effect transistor T biased by a DC supply Vcc via a resistor 70,
- a first diode 71 in series with a capacitor 72 between the point J and the gate of the transistor,
- a capacitor 73 and a resistor 74 in parallel between the gate of the transistor and ground, and
- a second diode 75.

Diagram 5N shows the potential at the gate (N) of the transistor which is at all times greater than or equal to Vcc provided that the opto-electronic system is operating; the transistor remains turned off.

If for any reason (failure of the light source, cutting of one of the optical fibers, failure of an electrical component, including the diode pump circuit, etc) the signal at J should disappear, the voltage at the gate of the transistor T disappears as the capacitor 73 discharges into the resistor 74 and a signal appears at the drain (X) of the transistor T. Note that only the D-type flip-flop is partially exempt from this self-monitoring.

Figure 6:
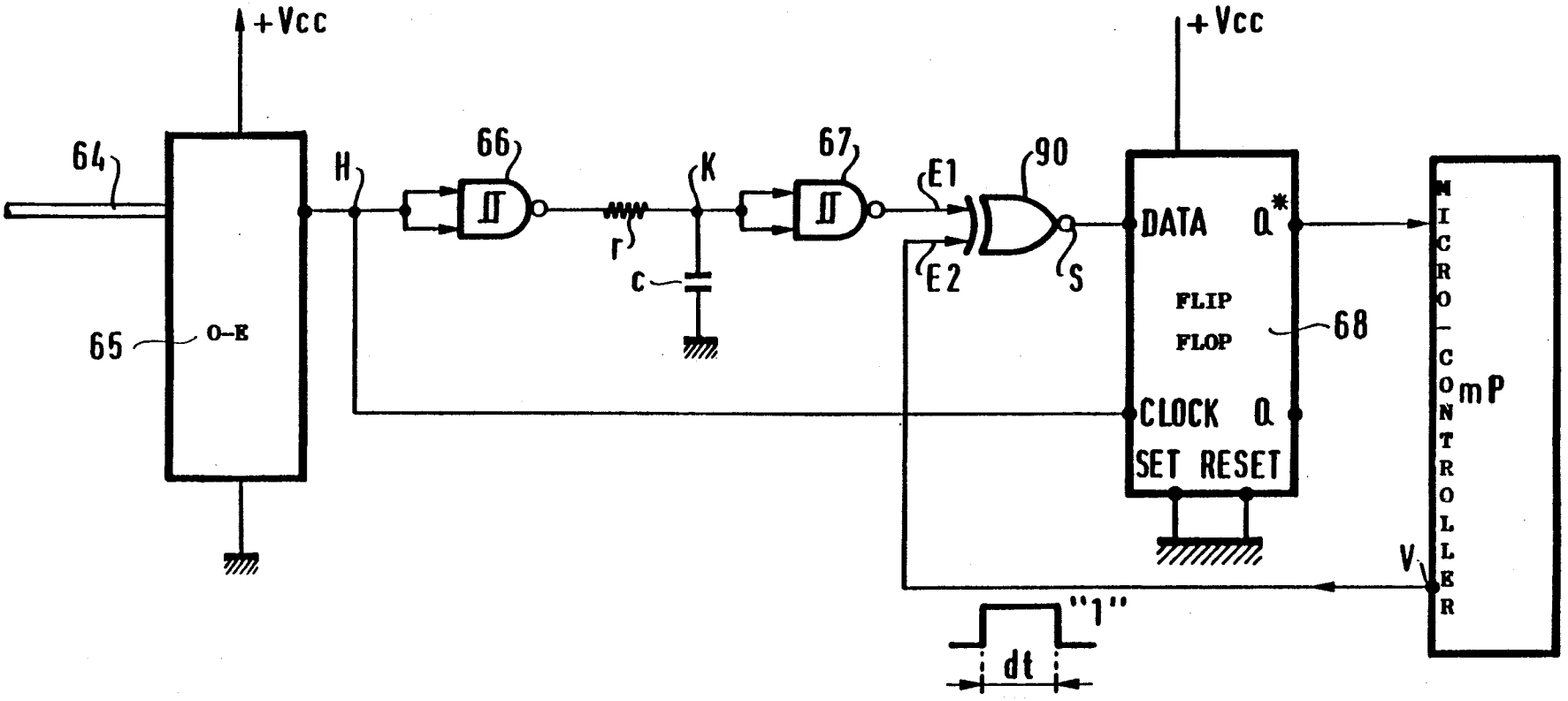
FIG. 6 shows an alternative embodiment of the self-monitor circuit.

FIG. 6 shows an alternative embodiment of the self-monitor circuit.

It differs from the FIG. 4 circuit in that the circuitry incorporating the transistor T has been omitted.

An exclusive-OR gate 90 with two inputs E1 and E2 and an output S is connected by its input E1 between the inverter 67 and the D-type flip-flop 68.

A microcontroller mP connected to the Q* output of the flip-flop 68 acquires this information and is adapted to apply to the input E2 a unit pulse "1" of duration dt>to. This pulse represents the start of self-monitoring and is referred to hereinafter as the test pulse.

The truth table for the exclusive-OR gate 90 is as follows:

| E1 | E2 | S |
|---|---|---|
| 0 | 0 | 0 |
| 0 | 1 | 1 |
| 1 | 0 | 0 |
| 1 | 1 | 0 |

If E2=0, the exclusive-OR gate copies the input E1 state to the output S with the result that this additional circuit does not modify the information supplied initially at Q*.

However, as soon as the test pulse is generated E2=1. The software having checked that the system is idle, no instruction having been executed, it is mandatory that Q* is replaced by $\overline{Q^*}$, whatever the initial value of Q*, if there are return pulses from the transducer. It is sufficient for the test pulse to have a width slightly greater than t0, the pulse transmission period.

To carry out the self-test the program first notes the value Q*o of $\overline{Q^*}$. It then sets E2 to "1" for a time dt and checks that during this window of duration dt Q* changes to Q1=Q*. When the pulse is cut off, the microcontroller mP opens a new time window of duration dt. In this second window it verifies that Q2=$\overline{Q1}$=Qo.

By this procedure, and by a relevant choice of dt, all of the measurement system is checked out including the D-type flip-flop 68 and the inverter 67 which was not monitored in the FIG. 4 circuit.

Note that failure of the exclusive-OR circuit 90 would also be sensed by the self-monitor because the result would be that Q* would not be replaced by $\overline{Q^*}$ when the test pulse is generated.

The self-monitoring may be carried out periodically, with its own period, or as part of the normal cycle of information acquisition by sampling at a given frequency.

Of course, the invention is not limited to the embodiments described and shown which are given by way of example only and in which the means or groups of means described may be replaced with equivalent means or groups of means.

I claim:

1. Device for signalling remotely the state of an apparatus able to assume a plurality of discrete states, comprising:

means for producing inside a screened enclosure a direct current voltage free of interference, said screened enclosure containing:

first means for producing from said direct current voltage electrical pulses whose duration is proportional to the value of an inductor which can assume distinct values according to the various states of the apparatus, second means for converting said electrical pulses into optical pulses and an optical fiber for transmitting said optical pulses out of said enclosure to a processor, said first means comprising a circuit for producing rectangular pulses of constant duration separated by equal time intervals, an integrator receiving said rectangular pulses, a first inverter receiving the output signals of said integrator and supplying calibrated pulses at its output, a time constant circuit comprising a resistor and said inductor, the output signals of said first inverter being applied to the input of said time constant circuit and to a second inverter, the output signals of said time constant circuit and said second inverter being fed to the input of a third inverter whose output is connected to an amplifier driving said second means.

2. Device according to claim 1 wherein said means for producing a direct current voltage comprises a photovoltaic cell inside said screened enclosure and adapted to be illuminated through a window in the latter by a light source.

3. Device according to claim 1 wherein said means for producing a direct current voltage comprise an integrated photovoltaic cell inside said screened enclosure and associated with an optical fiber fed with light by a laser diode.

4. Device according to claim 1 wherein said second means is a photodiode.

5. Device according to claim 1 wherein said processor comprises a demodulator and a self-monitor circuit.

6. Device according to claim 5 wherein said demodulator comprises a photovoltaic converter receiving the signal from said optical fiber, a Schmitt trigger and a D-type flip-flop.

7. Device according to claim 5 wherein said self-monitor circuit comprises a diode pump circuit driving an output transistor.

8. Device according to claim 6 wherein said self-monitor circuit comprises an exclusive-OR gate connected by a first input on an input side of said D-type flip-flop and having a second input connected to a microcontroller adapted to apply to said second input a tests pulse of duration exceeding the duration of said rectangular pulses, said microcontroller being connected to said D-type flip-flop and being programmed to observe a change of the position information during a monitoring period when the apparatus is idle between changes in said discrete states.

* * * * *